US005159886A

United States Patent [19]

Schaub et al.

[11] Patent Number: 5,159,886

[45] Date of Patent: Nov. 3, 1992

[54] PROCESS OF COMBUSTING COAL IN A CIRCULATING FLUIDIZED BED

[75] Inventors: Georg Schaub; Gebhard Bandel, both of Frankfurt am Main; Rainer Reimert, Idstein-Kröftel; Hans Beisswenger, Bad Soden, all of Fed. Rep. of Germany

[73] Assignee: Metallgesellschaft Aktiengesellschaft, Frankfurt am Main, Fed. Rep. of Germany

[21] Appl. No.: 827,011

[22] Filed: Jan. 28, 1992

[30] Foreign Application Priority Data

Feb. 1, 1991 [DE] Fed. Rep. of Germany ..... 4102959

[51] Int. Cl.[5] ..... F23D 1/00

[52] U.S. Cl. ..... 110/347; 110/212; 110/245; 110/345; 122/4 D; 422/183

[58] Field of Search ..... 110/344, 345, 212, 245, 110/211, 347; 122/4 D; 422/182, 183

[56] References Cited

U.S. PATENT DOCUMENTS 4,815,418 3/1989 Maeda et al. ..... 122/4 D
4,843,981 7/1989 Goldbach et al. ..... 122/4 D X
5,048,432 9/1991 Hofmann et al. ..... 122/4 D X

FOREIGN PATENT DOCUMENTS 0046406 2/1982 European Pat. Off. .
3413564 10/1985 Fed. Rep. of Germany ..... 110/212

*Primary Examiner*—Edward G. Favors
*Attorney, Agent, or Firm*—Herbert Dubno

[57] ABSTRACT

Granular coal is combusted in a circulating fluidized bed system comprising a combustion chamber, a separator and a recycle line for recycling solids from the separator to the combustion chamber. Gas from carbonization is added to the oxygen-containing combustion gas withdrawn from the combustion chamber and is at least partly combusted in said combustion gas to increase the temperature of the combustion gas to about 850° to 1200° C. The gas from carbonization is produced by the heating of granular coal.

7 Claims, 1 Drawing Sheet

PROCESS OF COMBUSTING COAL IN A CIRCULATING FLUIDIZED BED

FIELD OF THE INVENTION

Our present invention relates to a process of combusting granular coal in a circulating fluidized bed system.

More particularly, the invention relates to a process carried out in a system which comprises a combustion chamber, a separator for separating combustion gas and solids, and a recycle line for recycling solids from the separator to the combustion chamber wherein granular coal and air are fed to the lower portion of the combustion chamber and solids and oxygen-containing combustion gas are withdrawn from the combustion chamber and fed to the separator and combustion gas from the separator is fed to a cooler.

BACKGROUND OF THE INVENTION

The combustion of solid fuels in a circulating fluidized bed, e.g. to produce steam, is known and has been described in European Patent 0 046 405, in published German Application 38 00 863 and in the corresponding U.S. Pat. No. 4,884,408.

It has been found that the combustion gas (flue gas) produced by the combustion of hard coal or also of brown coal will have a high content of the nitrogen oxide $N_2O$. That $N_2O$ will increase the greenhouse effect in the atmosphere and will promote the decomposition of ozone. $N_2O$ is decomposed at about 850° to 1100° C.

OBJECT OF THE INVENTION

It is an object of the invention to provide an improved combustion process wherein the content of $N_2O$ in the combustion gas which enters the atmosphere is minimized.

SUMMARY OF THE INVENTION

This is accomplished in accordance with the invention by introducing a gas, which has been produced by the carbonization of granular coal (i.e. a gas produced by coal distillation) and contains combustible constituents, into the oxygen-containing combustion gas and the gas produced by the carbonization is combusted at least in part in the combustion gas to increase the temperature of the combustion gas to about 850° to 1200° C.

In the process in accordance with the invention, the temperature increase in the combustion gas is suitably effected in that the coal to be carbonized is the same as the coal combusted in the combustion chamber. The combustion gas which is at the elevated temperature in the range from about 850° to 1200° C. has only a very low $N_2O$ content not in excess of about 50 ppm and, in addition, the efficiency with which steam is subsequently produced in the cooler is also increased.

The gas produced by carbonization is suitably added to the combustion gas in the upper portion of the combustion chamber or outside the combustion chamber, e.g. in the succeeding lines. In a modification of the invention, granular coal and hot solids from the separator are mixed in a mixing zone in which the coal is subjected to carbonization, and the gas produced by said carbonization is withdrawn. The gas produced by the distillation or carbonization of the coal consists mainly of the combustible components, carbon monoxide, hydrogen and methane. The solid residue formed by the carbonization consists mainly of coke and at least part of said residue can be fed to and combusted in the combustion chamber. Thus the gas from carbonization can be produced at low cost.

Alternatively, the gas which has been produced by carbonization and contains combustible components can be obtained by using the gas mixture formed in the lower part of the combustion chamber as the gas from carbonization. In that part of the combustion chamber there will be reducing conditions at temperatures of about 600° to 850° C. so that the granular coal is mainly carbonized and the resulting gas mixture contains CO and $CH_4$. In that case there is no need for additional equipment for effecting a carbonization.

More particularly, the process of the invention can comprise the steps of:

(a) burning granular coal in a circulating fluidized bed system by:

($a_1$) feeding granular coal to a fluidized bed to which an oxygen-containing gas is supplied and burning the granular coal of the fluidized bed, ($a_2$) continuously entraining from the fluidized bed a mixture of particles and an oxygen-containing combustion gas produced in the bed by the burning of the granular coal, ($a_3$) continuously separating the particles from the combustion gas, and ($a_4$) continuously recirculating particles separated in step ($a_3$) to the fluidized bed;

(b) cooling the combustion gas;

(c) carbonizing granular coal to produce a carbonization gas containing combustible components; and (d) introducing the carbonization gas into the oxygen-containing combustion gas and burning the carbonization gas in the combustion gas to increase a temperature of the combustion gas prior to cooling in step (b) to about 850° to 1200° C.

PCT Patent Application WO 88/05494 contains a description of a combustion of coal in a fluidized bed furnace. The flue gases withdrawn from the furnace are fed to a steam generator, which is also fed with pulverized coal and air and is used to combust the mixture at about 1000° to 1200° C. It is an object of that combustion in the steam generator to eliminate toxic substances, particularly dioxins, in the flue gas, and the content of $N_2$ will necessarily also be decreased at the high temperatures.

However, very expensive equipment is required for that known process; for that reason the process cannot be used in practice or can be used only in rare cases. By contrast, an expensive combustion zone is not used in the process in accordance with the invention and the excess oxygen contained in the combustion gas is generally sufficient to ensure that the desired afterburning will be effected by the addition of gas from carbonization.

BRIEF DESCRIPTION OF THE DRAWING

The above and other objects, features and advantages of the present invention will become more readily apparent from the following description, reference being made to the accompanying drawing in which.

SPECIFIC DESCRIPTION

Figure 1:
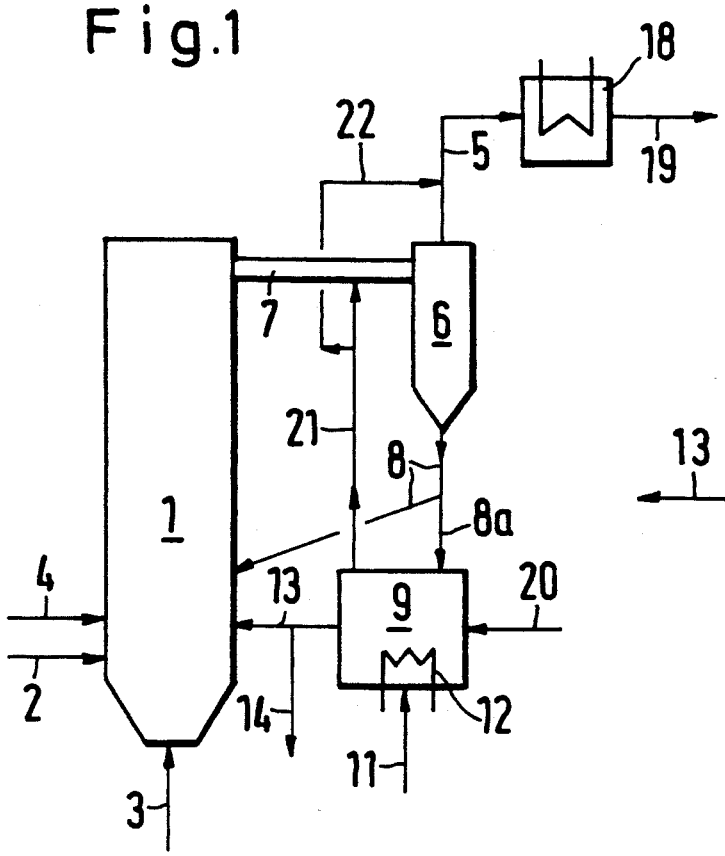
FIG. 1 is a flow diagram of a plant for combusting coal in a circulating fluidized bed.

According to FIG. 1, granular coal is fed in line 2 to the combustion chamber 1 and is combusted therein in a fluidized state together with air from lines 3 and 4. The plant is operated as a circulating fluidized bed system and comprises a separator consisting of a cyclone 6, which is connected by a duct 7 to the upper portion of the combustion chamber 1, and a solids recycle line 8. The heat which is generated can be used, e.g. to generate steam; this is not illustrated in the drawing. The gas leaving the cyclone 6 flows in line 5 to a cooler 18 and then flows in line 19, e.g. to a deduster, not shown, before the gas is discharged into the atmosphere.

The known parts of the plant also comprise a fluidizing chamber 9, which is fed through line 8*a* with fine-grained solids from the cyclone 6. The solids are fluidized in the chamber 9 by fludizing air from line 11. Part of the heat is extracted in the indirect heat exchanger 12. The solids thus treated are at least partly recycled through line 13 to the combustion chamber 1. Surplus solids can be withdrawn in line 14 from the process.

Several possibilities will be available if it is desired to increase the temperature of the combustion gas into the range from 900° to 1200° C. by a feeding and combustion of gas from carbonization. According to FIG. 1 the gas from carbonization is produced in that the hot solid residue from line 8*a* is mixed in the fluidizing chamber 9 with granular coal from line 20 so that the coal is subjected to a carbonization in a mixture which is at a temperature of about 300° to 800° C. The mixing of the solids is assisted by the fludizing air from line 11. The indirect cooling in 12 may be omitted entirely or in part. The gas produced by carbonization contains combustible components and optionally contains the fluidizing gas from line 11 and is withdrawn in line 21.

In order to effect the desired afterburning, that gas from carbonization may be distributed into the duct 7 or may be added through line 22 to the combustion gas in line 5 so that the afterburning will be effected there. The oxygen contained in the combustion gas is sufficient for the desired afterburning. As a result, the combustion gas leaving the cyclone 6 in line 5 has only an extremely low residual $N_2O$ content not in excess of 50 ppm.

If the gas from carbonization is added through lines 21 or 22 to the combustion gas, we may effect the intense mixing in an enlarged portion of the line 7 or 5. Such enlarged portions or mixing chambers have been omitted in the drawing for the sake of simplicity.

Figure 2:
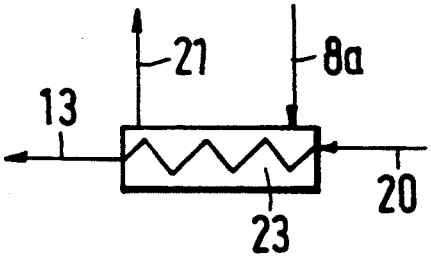
FIG. 2 is a diagram of a second version of the mixing zone used for the carbonization of coal.

Instead of the fluidizing chamber 9, the means for subjecting the coal from line 20 to carbonization may consist in accordance with FIG. 2 of a screw mixer 23, known per se. The hot solid residue from the cyclone 6 is fed in line 8*a* to that screw mixer. The residue is mixed with the coal from line 20 in the screw mixer 23, which feeds the mixture to the line 13. The gas from carbonization is withdrawn in line 21. Whether the screw mixer 23 or the fluidizing mixer 9 shown in FIG. 1 are employed, the sensible heat of the solids contained in the circulating fluidized bed system is used for the carbonization of the granular coal and there is no need for an additional energy source.

Figure 3:
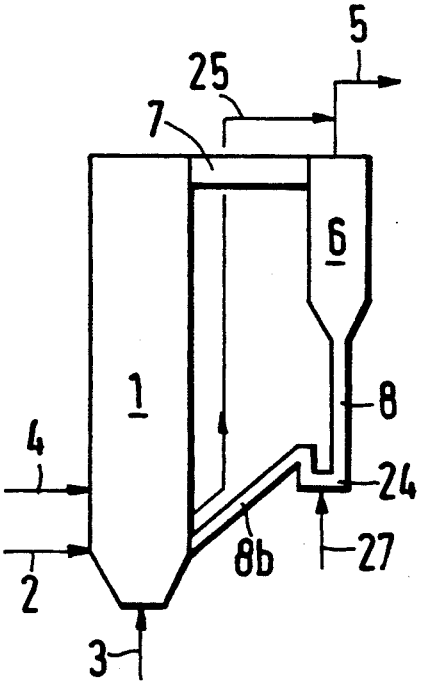
FIGS. 3 and 4 illustrate additional embodiments of the combustion plant.

With reference to FIG. 3, we will now explain, in conjunction with the explanation given in FIG. 1, how the gases produced by the carbonization in the lower portion of the combustion chamber 1 can be used for an afterburning.

For that purpose, a line 25 for conducting gas from carbonization is connected to the combustion chamber 1 close to the outlet of the solids recycle line 8*b* and feeds gases from carbonization to the line 5. The line 25 has such an inside diameter that only a relatively small part of the gases present in the lower portion of the combustion chamber is withdrawn in line 25. A flow control valve (not shown) is not necessary in most cases.

In the plant shown in FIG. 3, the solids line 8 leads from the cyclone 6 to a siphon 24, which is known per se and is fed through line 27 with fluidizing and conveying air. The siphon 24 permits a bed of bulk material to be formed in the line 8 and that bed acts as pressure barrier between the combustion chamber 1 and the cyclone 6. The solids are fed through line 86 into the combustion chamber.

Figure 4:
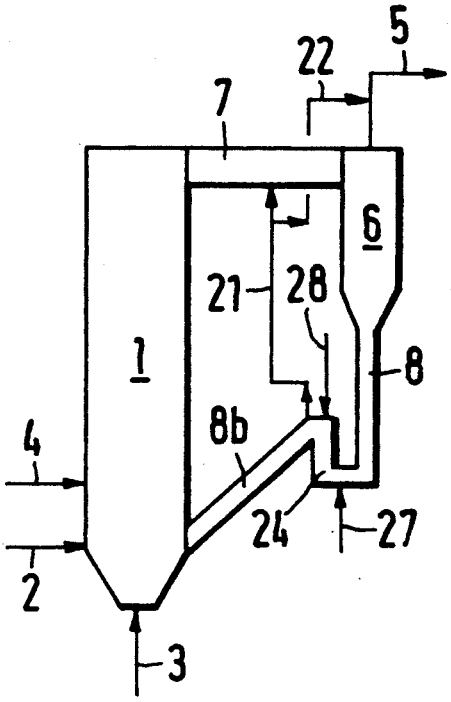

In accordance with FIG. 4 the gas from carbonization is produced in the siphon 24, which is fed in line through line 27 with fluidizing and entraining air. Granular coal is fed through line 28, which is mixed with the hot solid residue from line 8 and is thus heated to produce gas by carbonization. In a manner which is similar to that shown in FIG. 1, that gas from low-temperature carbonization may be distributed into the duct 7 or may be added through lines 21 and 22 to the combustion gas in line 5.

EXAMPLE 1

A plant as shown in FIGS. 1 and 2 comprises a screw mixer (FIG. 2) rather than the fluidizing mixer 9 and also comprises a combustion chamber 1 having a height of 30 m. That plant is operated as follows:

| | Line | Rate | Calorific value or temperature |
|---|---|---|---|
| Coal supply | 2 | 12,000 kg/h | 25,000 kJ/kg |
| Primary air | 3 | 56,000 $sm^3/h$[1] | 200° C. |
| Secondary air | 4 | 84,000 $sm^3/h$ | 200° C. |
| Combustion gas | 7 | 138,850 $sm^3/h$ | 850° C. |
| Total solids | 8 | 500,000 kg/h | |
| Solids fed to screw mixer | 8a | 25,000 kg/h | 865° C. |
| Coal for carbonization | 20 | 4,000 kg/h | 25,000 kJ/kg |
| Gas from carbonization | 21 and 22 | 1,125 $sm^3/h$ | 20,000 $kJ/sm^3$ |

[1]$sm^3$ = standard cubic meter ($m^3$ STP)

The combustion gas in line 7 contains 5.6% $O_2$. When the gas from carbonization, which is supplied through lines 21 and 22, has been admixed, afterburning takes place in line 5, which results in a temperature of 970° C. and in an exhaust gas having an $N_2O$ concentration of only 10 ppm. Without that afterburning, the exhaust gas in line 5 is at a temperature of 865° C. and has an $N_2O$ concentration of about 70 ppm.

EXAMPLE 2

A plant as shown in FIG. 3, which comprises a combustion chamber 1 having a height of 30 m, is operated as follows:

| | Line | Rate | Heating value or temperature |
|---|---|---|---|
| Coal supply | 2 | 16,000 kg/h | 25,000 kJ/kg |
| Primary air | 3 | 56,000 $sm^3/h$ | 200° C. |
| Secondary air | 4 | 84,000 $sm^3/h$ | 200° C. |
| Combustion gas | 7 | 126,975 $sm^3/h$ | 860° C. |

-continued

| | Line | Rate | Heating value or temperature |
|---|---|---|---|
| Solids | 8 | 500.000 kg/h | |
| Gas from carbonization | 25 | 13,000 $sm^3/h$ | 2,650 $kJ/sm^3$ |

The afterburning in line 5 results in a temperature rise to 965° C. and in a decrease of the $N_2O$ content to 15 ppm.

We claim:

1. A process for combusting granular coal, comprising the steps of:

(a) burning granular coal in a circulating fluidized bed system by:

($a_1$) feeding granular coal to a fluidized bed to which an oxygen-containing gas is supplied and buring the granular coal of the fluidized bed, ($a_2$) continuously entraining from said fluidized bed a mixture of particles and an oxygen-containing combustion gas produced in said bed by the burning of the granular coal, ($a_3$) continuously separating said particles from said combustion gas, and ($a_4$) continuously recirculating particles separated in step ($a_3$) to said fluidized bed;

(b) cooling said combustion gas;

(c) carbonizing granular coal to produce a carbonization gas containing combustible components; and (d) introducing said carbonization gas into said oxygen-containing combustion gas and buring said carbonization gas in said combustion gas to increase a temperature of said combustion gas prior to cooling in step (b) to about 850° to 1200° C.

2. The process defined in claim 1 wherein said carbonization gas is added to said combustion gas outside said fluidized bed and upstream from said cooling in step (b).

3. The process defined in claim 2 wherein said carbonization gas is added to said combustion gas downstream of the separation of said particles from said combustion gas.

4. The process defined in claim 1 wherein said granular coal for carbonization is mixed with hot solids formed by the particles separated from said combustion gas in a mixing zone in which the coal mixed with the hot solids is subjected to carbonization and the carbonization gas is withdrawn from said mixing zone and added to said combustion gas.

5. The process defined in claim 1 wherein said carbonization gas is drawn from a lower portion of a combustion chamber containing said fluidized bed.

6. The process defined in claim 4 wherein a solid residue is formed by the carbonization and is fed from said mixing zone to a combustion chamber containing said fluidized bed.

7. An apparatus for combusting granular coal, comprising:

a fluidized-bed combustion chamber;

means for burning granular coal in a circulating fluidized bed system in said combustion chamber, including means for feeding granular coal to a fluidized bed to which an oxygen-containing gas is supplied in said chamber and for burning the granular coal of the fluidized bed;

means for continuously entraining from said fluidized bed a mixture of particles and an oxygen-containing combustion gas produced in said bed by the burning of the granular coal;

means for continuously separating said particles from said combustion gas;

means connected with said separating means for continuously recirculating particles separated from said combustion gas to said fluidized bed;

means for cooling said combustion gas;

means for carbonizing granular coal to produce a carbonization gas containing combustible components; and means for introducing said carbonization gas into said oxygen-containing combustion gas and burning said carbonization gas in said combustion gas to increase a temperature of said combustion gas prior to cooling to about 850° to 1200° C.

* * * * *